United States Patent [19]

Bratschitsch

[11] 4,057,364

[45] Nov. 8, 1977

[54] FLUID TRANSFER SYSTEMS AND VALVES THEREFOR

[76] Inventor: John Bratschitsch, 210 Edgemont St. South, Hamilton, Ontario, Canada

[21] Appl. No.: 640,318

[22] Filed: Dec. 12, 1975

Related U.S. Application Data

[62] Division of Ser. No. 499,877, Aug. 23, 1974, abandoned.

[51] Int. Cl.[2] ..... F04B 49/00

[52] U.S. Cl. ..... 417/34; 137/205; 417/63; 417/120; 417/129; 417/149

[58] Field of Search ..... 417/34, 63, 118, 120, 417/126, 129, 137, 138, 148, 149, 199 A, 200, 211.5, 297.5; 137/160, 205; 73/306, 323; 116/118

[56] References Cited

U.S. PATENT DOCUMENTS

| | | | |
|---|---|---|---|
| 1,587,864 | 6/1926 | Sargent | 137/205 |
| 2,593,172 | 4/1952 | Neumann | 73/323 |
| 2,664,911 | 1/1954 | Thompson et al. | 137/205 |
| 2,900,915 | 8/1959 | Rowell | 417/34 X |
| 3,599,639 | 8/1971 | Spotz | 137/205 X |
| 3,706,319 | 12/1972 | Neese et al. | 137/205 |
| 3,827,452 | 8/1974 | Baumgarten | 137/205 |
| 3,867,070 | 2/1975 | Sloan | 417/200 X |

FOREIGN PATENT DOCUMENTS

| | | | |
|---|---|---|---|
| 684,153 | 4/1964 | Canada | 137/205 |

*Primary Examiner*—William L. Freeh
*Assistant Examiner*—Edward Look
*Attorney, Agent, or Firm*—Hirons & Rogers

[57] ABSTRACT

A pumping system intended especially for highly contaminated liquids uses an air pump for drawing liquid into or discharging the liquid from a vessel by creating respectively a vacuum or a pressurized condition within the vessel. A special valve device is provided for the system comprising an air filter in combination with a float-actuated, shut-off switch to preclude the entry of air or liquid-borne contaminants into the pump. The float-actuated switch is arranged to disable a prime mover used for driving the pump. An additional safety feature of the system comprises the provision of an intermediate float valve located between the pump and the valve device, to preclude the passage of liquid therebetween, the intermediate valve having a sight glass to detect leakage liquid and a drain cock to permit drainage of such liquid.

7 Claims, 2 Drawing Figures

FLUID TRANSFER SYSTEMS AND VALVES THEREFOR

CROSS REFERENCE TO RELATED APPLICATIONS

This application is a division of my earlier application Ser. No. 499,877 filed Aug. 23, 1974, now abandoned.

FIELD OF THE INVENTION

This invention is directed to fluid transfer systems such as are used in combination with a liquid storage vessel to draw liquid therein and to discharge liquid therefrom, and to valves for use in such systems in combination with an air pump and a prime mover for the pump.

REVIEW OF THE PRIOR ART

The handling of contaminated and/or corrosive liquids, e.g. containing abrasives or sludges therein, presents considerable problems, particularly in view of the hazard to any pumping mechanism used for the transfer of the liquids into and out of a vessel used for its storage and/or transfer. In order to avoid the need for passage of such liquids through the pump it is usual to employ a reversible air pump arranged to control the pressure condition within the container into which the contaminated liquid is drawn under suction, or from which it is expelled by container pressurization.

Such pumps are of high capacity and high pressure and consequently are relatively expensive; owing to the nature of the liquids or semi-liquids requiring to be pumped, and the quality of the operators frequently used for such work, it is extremely difficult to substantially entirely preclude the carryover of small quantities of liquids to the pump of the system, and even small quantities will be sufficient to damage the expensive pump.

The present invention provides a fluid transfer system and a valve therefor wherein the passage of liquid or air-borne contaminants to the pump is substantially precluded.

DEFINITION OF THE INVENTION

In accordance with this invention there is provided a fluid transfer system for transferring liquid from a source thereof to the interior of a liquid-receiving tank by the withdrawal of air from the said interior and for transferring liquid from the tank interior to the exterior thereof by the supply of air to the said interior comprising: an air transfer pump unit for the said withdrawal of and supply of air; an air transfer passage connecting the interior of the tank to the air transfer pump unit; a first float responsive means positioned at least partly in the tank interior and actuated in response to the presence of a predetermined level of liquid in the tank interior to close the air transfer passage and thereby preclude the passage of liquid into the air transfer passage; and a secondary float valve means connected in the air transfer passage between the said air pump unit and the said first float responsive means and actuated in response to receipt of liquid from the air transfer passage between the first float responsive means and itself to close the air transfer passage and thereby to further preclude the possibility of passage of liquid from the tank interior to the air transfer pump unit.

The float responsive means may include a float positioned to be engaged by liquid in the tank, and switch means are connected therewith for actuation on floatation of the float in the liquid to terminate withdrawal of air from the said tank interior. The system may be employed in combination with an engine connected in driving relation with the air transfer pump unit for operation thereof, wherein said switch means comprises a disabling switch operable upon the presence of the said predetermined level of liquid in the tank interior to stop operation of the engine and thereby prevent operation of the pump unit. Preferably the system is used in combination with a truck wherein the said tank is a liquid transfer tank mounted on the truck and having said engine as the propulsive means therefore, said float responsive means being mounted at the top of the tank.

A system and valve means in accordance with the present invention is of particular utility for a truck-mounted tank and pump system, in that a suction hose may be connected from the truck tank to a source of contaminated liquid to be pumped into the tank. The truck engine power take-off powers the pump which is arranged by an associated controllable valve system to evacuate the interior of the tank connected via the above-mentioned primary and a secondary float valves. When the tank is sufficiently filled with the liquid to trip the primary float valve the truck engine is shut-down, in the manner disclosed, by disconnecting the ignition. Thus the truck may be left unattended during the tank filling operation without posing any danger of damage to the comparatively expensive air pump.

DESCRIPTION OF THE DRAWINGS

A preferred embodiment will now be described, by way of example, with reference to the accompanying diagrammatic drawings, wherein.

DESCRIPTION OF THE PREFERRED EMBODIMENT

Figure 1:
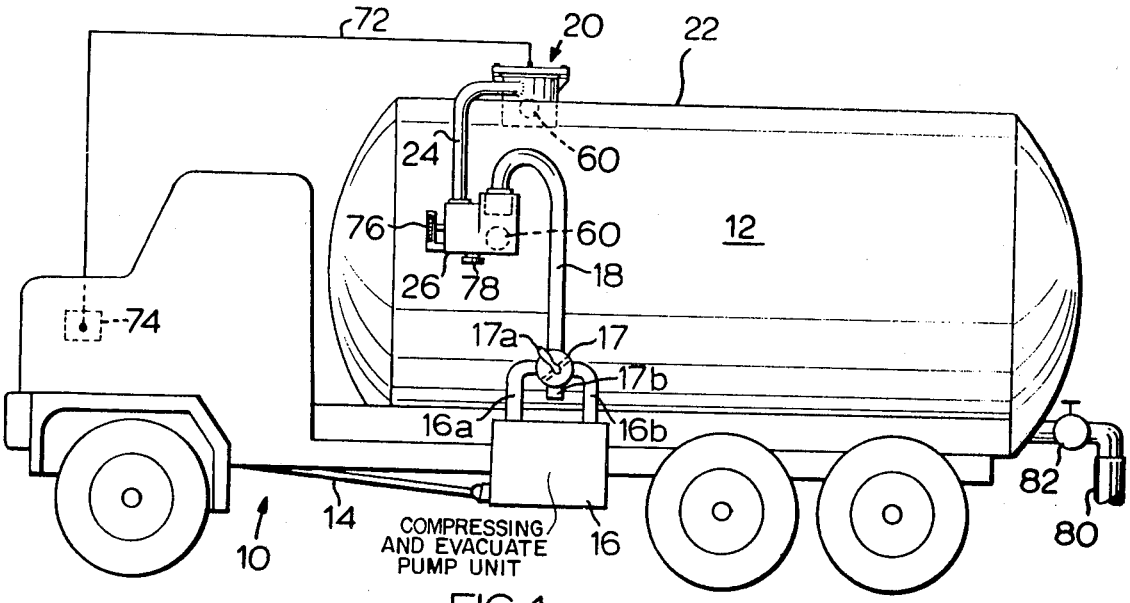
FIG. 1 is a side view of a tank truck incorporating a fluid transfer system in accordance with the present invention.

Referring to FIG. 1 a truck 10 has a bulk liquid tank 12 mounted thereon. A power take-off shaft 14 from the truck engine (not shown) is connected in driving relation with an air compressing or evacuating pump unit 16 of known type operable in known manner, e.g. by a change-over valve or valves in its piping, in air compressing or air evacuating mode with regard to an external connection hose 18, through which the interior of the tank may be respectively selectively pressurized or evacuated under the control of an operator. The structure of such pump units is sufficiently well-known to those skilled in the art as not to require any more detailed explanation or illustration. For example, air is supplied to the pump 16 by pipe **16*a* and pressurized air is discharged therefrom by pipe 16*b*, the pipes 16*a* and 16*b* being connected via a four-way valve 17 to the hose 18. The valve is controlled by a handle 17*a* and has its fourth port 17*b* opening to atmosphere. With the handle 17*a* in one alternative position outlet pipe 16*b* is connected to hose 18 and inlet pipe 16*a* is connected to atmosphere via the port 17*b*, so that the interior of tank 12 is pressurized. With the handle in the alternative position the inlet pipe 16*a* is connected to hose 18 and outlet pipe 16*b* is connected to port 17*b***, so that the tank interior is evacuated. A primary float responsive valve means 20 in accordance with the invention is mounted at the top of the tank 12 in the wall 22 thereof, and is connected by a hose 24 with a secondary float valve 26, to which the hose 18 also connects.

Figure 2:
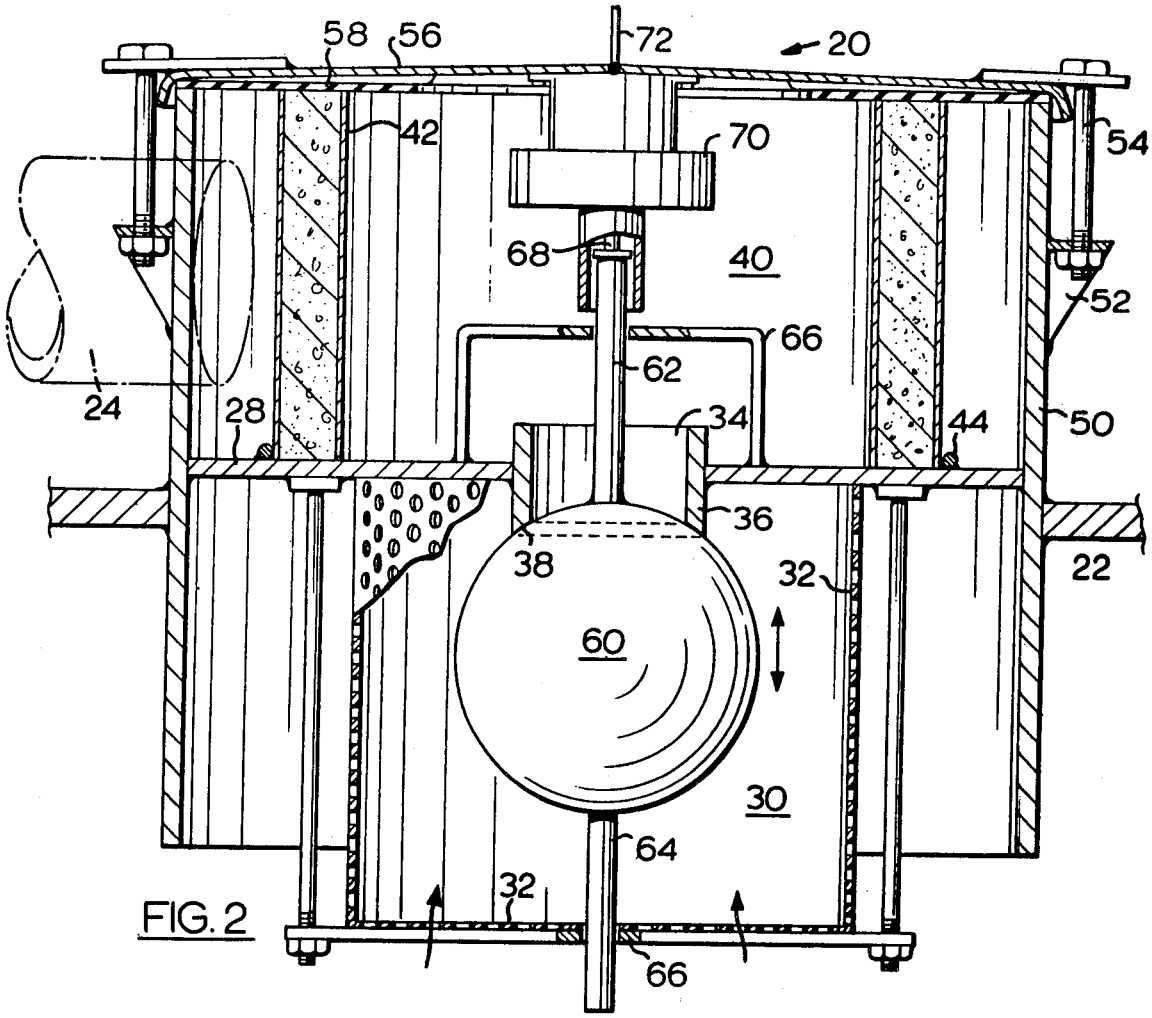
FIG. 2 is a diametrical sectional elevation of a primary float-responsive valve means in accordance with this invention.

Referring now especially to FIG. 2, the interior of the valve 20 is divided by a barrier 28 into a lower or secondary chamber 30 bounded by perforated walls 32, which constitute a particle filter. This chamber 30 and the tank interior constitute a so-called second zone of the system. A gas transfer passage formed by a tube 36 mounted in the barrier 28 and having a chamfered seat portion 38 connects the secondary chamber 30 to a primary chamber 40 which is partially bounded by an air filter cartridge 42 of cylindrical form, a ring 44 serving to locate the cartridge radially. This chamber 40 constitutes part of the so-called first zone of the system. A cylindrical wall 50 of the valve is welded into an aperture in the tank wall 22 and has clamp brackets 52 fixed thereto for the attachment of bolts 54 which serve to secure a cover 56 on the valve. A resilient gasket 58 is interposed between the cover 56 and the upper edge of the filter cartridge 42, the cover completing the chamber 40.

A float 60 is mounted by means of coaxially aligned, diametrically-opposed stems 62 and 64 for vertical movement in upper and lower guides 66. The upper stem 62 engages the operating member 68 of a switch 70 mounted on the inside of the cover 56, from which a connection 72 extends to the ignition system 74 of the vehicle (illustrated diagrammatically in FIG. 1).

The secondary float valve 26 includes an internal barrier 28, a passage tube 36 and a valve float 60, but does not include a switch 70 and does not necessarily include particle filter 32 and/or air filter 42. A sight glass 76 permits visual detection of the presence of liquid within the valve 26, and a removeable drain plug 78 facilitates drainage of liquid from out of the valve.

In operation, the inlet of a filler hose 80 is submerged beneath the surface of a liquid to be transferred to the interior of the tank 12, and the valve 82 is opened; upon engagement of the engine power take off 14 to drive the pump 16 in an air evacuating mode air pressure within the tank 12 is reduced and liquid flows through the hose 80 to fill the tank. When the liquid level raises the float 60 sufficiently to actuate the cut-off switch 70 the circuit represented by connection 72 is opened and the ignition of the truck engine is switched off. Closure of the valve 82 completes the operation. In order to empty the tank 12 when desired the output of pump 16 is reversed to positively pressurize the tank 12 and discharge the liquid contents of the tank when the valve 92 is opened.

A further function provided by the primary valve 20 is the cooperation of the spherical float member 60 with the chamfered seat 38 to provide a positive barrier to the flow of liquid from the second zone into the first zone, and also to preclude upward splashing of the liquid into contaminating relation with the air filter cartridge 42 during movement of the truck. In the event that some liquid should nevertheless escape past the valve 20 it is further prevented by the secondary valve 26 from reaching the pump.

It will be understood that the portion of the vehicle engine ignition circuit controlled by the switch 70 will usually be additional to the standard circuit, so that operation of the truck engine in a truck driving mode may be effected after completion of a tank filling operation, despite the above-mentioned disabling of the engine ignition circuit by the actuation of the switch 68. The specific electrical circuit required for such operation will be apparent to those skilled in the art and further description and illustration thereof is not believed necessary. The present invention thus provides a simple, low cost and robust control system and valve therefor which may be readily operated, serviced and maintained.

I claim:

1. A fluid transfer system for transferring liquid from a source thereof to the interior of a liquid-receiving tank by the withdrawal of air from the said interior and for transferring liquid from the tank interior to the exterior thereof by the supply of air to the said interior comprising:

an air transfer pump unit for the said withdrawal of and supply of air;

an air transfer passage connecting the interior of the tank to the air transfer pump unit;

a first float responsive means positioned at least partly in the tank interior and actuated in response to the presence of a predetermined level of liquid in the tank interior to close the air transfer passage and thereby preclude the passage of liquid into the air transfer passage;

and a secondary float valve means connected in the air transfer passage between the said air pump unit and the said first float responsive means and actuated in response to receipt of liquid from the air transfer passage between the first float responsive means and itself to close the air transfer passage and thereby to further preclude the possibility of passage of liquid from the tank interior to the air transfer pump unit.

2. The system claimed in claim 1, in combination with an engine connected in driving relation with the air transfer pump unit for operation thereof, wherein said first float responsive means includes a float positioned to be engaged by liquid in the tank, and switch means are connected therewith for actuation on floatation of the float in the liquid, and wherein said switch means comprises a disabling switch operable upon the presence of the said predetermined level of liquid in the tank interior to stop operation of the engine and thereby stop operation of the pump unit.

3. The system claimed in claim 2, in combination with a truck wherein the said tank is a liquid transfer tank mounted on the truck and having said engine as the propulsive means therefor, said float responsive means being mounted at the top of the tank.

4. The system claimed in claim 3, wherein said secondary float valve means includes a sight glass to permit visual detection of the presence of liquid in the valve means, and a drain for draining such liquid from the valve means.

5. The system claimed in claim 1, wherein the air transfer passage is connected to the tank interior by an air transfer port and the said first float responsive means comprises a floatable ball adapted upon floatation in said predetermined level of liquid to close the port.

6. The system claimed in claim 5, wherein an air filter is mounted in the first float responsive means between the air transfer port and the floatable ball to filter air passing through the air transfer port, and a liquid filter means is mounted in the first float responsive means between the floatable ball and the tank interior for filtering liquid passing therethrough to the floatable ball.

7. The system claimed in claim 1, wherein said secondary float valve means includes a sight glass to permit visual detection of the presence of liquid in the valve means, and a drain for draining such liquid from the valve means.

* * * * *